United States Patent [19]

Hooper et al.

[11] 4,337,783

[45] Jul. 6, 1982

[54] FORMING SHEET FROM RECONSTITUTED TOBACCO

[75] Inventors: John D. Hooper, Keynsham; John F. Britton, Bishopsworth, both of England

[73] Assignee: Imperial Group Limited, London, England

[21] Appl. No.: 231,145

[22] Filed: Feb. 3, 1981

[30] Foreign Application Priority Data

Feb. 9, 1980 [GB] United Kingdom ..... 8004414

[51] Int. Cl.[3] ..... A24B 3/14

[52] U.S. Cl. ..... 131/375

[58] Field of Search ..... 131/353, 354, 355, 356, 131/357, 370, 371, 372, 374, 375

[56] References Cited

U.S. PATENT DOCUMENTS

| | | | |
|---|---|---|---|
| 3,203,432 | 8/1965 | Green et al. | 131/375 |
| 3,983,884 | 10/1976 | Detert et al. | 131/355 |
| 4,144,894 | 3/1979 | Schmidt et al. | 131/355 |

*Primary Examiner*—V. Millin

*Attorney, Agent, or Firm*—Larson and Taylor

[57] ABSTRACT

A method of forming sheet from reconstituted tobacco involves the formation of a high solids content slurry of which the particle size is less than 60 B.S. mesh. The slurry is then extruded through a single pair of rollers onto a wire mesh conveyor, or onto a continuous casting band which is itself supported by one of the rollers. The high solids content reduces the energy costs in drying the extruded sheet and the use of a single pair of rollers reduced the costs of the machinery.

7 Claims, 2 Drawing Figures

HIGH SOLIDS PROCESS (SCHEMATIC)

FORMING SHEET FROM RECONSTITUTED TOBACCO

TECHNICAL FIELD

During cigarette manufacture a certain amount of waste particulate tobacco is produced whose particle size is too small for it to be suitable for commercial use. Thus, various methods have been proposed for processing the waste tobacco into sheet form in which it may be used commercially, e.g. as cigarette filler.

BACKGROUND ART

One previously proposed method of reprocessing waste tobacco comprised forming a mixture of ground tobacco particles, a binder and at least 84% by weight water and casting the slurry by means of a reverse roll caster onto a steel band where it is dried to form a sheet of reconstituted tobacco. However, due to the high water content of the slurry, a large amount of energy is needed to dry the sheet and consequently the process is expensive to use. If the water content of the slurry was reduced to about 30% by weight in order to reduce the drying cost it was necessary to run the slurry through a multi-roll system to produce sheet of the required thickness. However the use of the multi-roll system increased the cost of the sheet production as the system was complex, expensive to buy and to maintain.

INVENTION

A method of forming a continuous tobacco sheet comprising the steps of (a) forming a slurry comprising 36.5–60% by weight of ground tobacco particles having a particle size of less than 60 B.S. mesh (250 microns), 3.5–10% by weight of binder and 30–60% water, (b) extruding the slurry between a pair of contra-rotating rollers to form an extruded sheet, (c) and drying the sheet.

DRAWINGS

Figure 1:
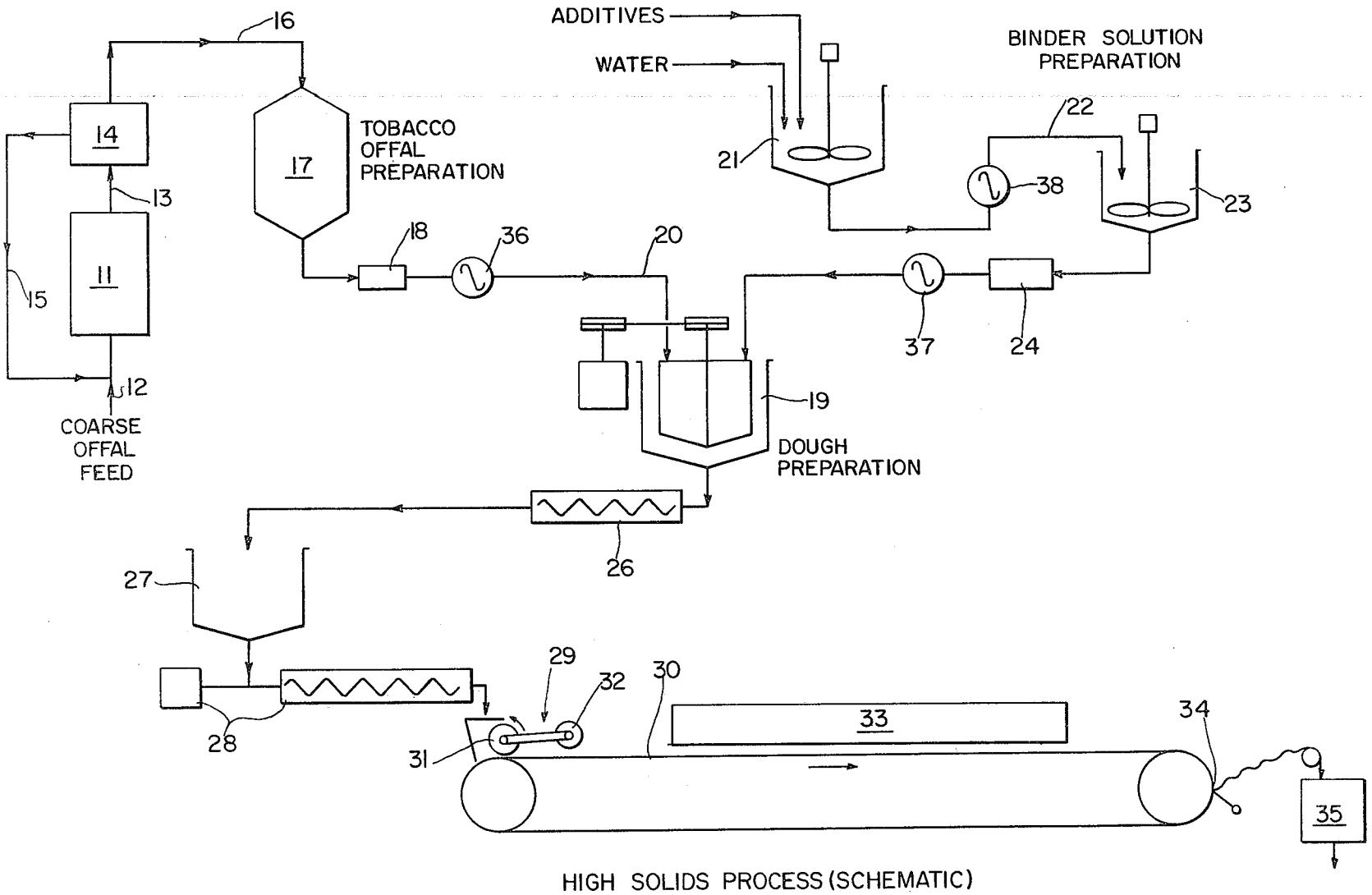

The invention will now be described by way of example with reference to the accompanying drawings of which FIGS. 1 and 2 each show a schematic layout of an apparatus for forming reconstituted tobacco sheet.

Slurry for the process is prepared from tobacco offal and binder solution. Coarse offal comprising stem and other waste tobacco is fed into a dry hammer mill 11 along pipe 12. The tobacco is ground to a mesh size of below B.S. 60 mesh and is then fed along pipe 13 to an air classifier or sieve screen 14. In the classifier 14 particles whose size is greater than B.S. 60 mesh are separated out and are returned along pipe 15 to be re-ground in hammer mill 11. Tobacco particles of an acceptable size are then passed along pipe 16 to a storage silo 17. Form the silo the ground tobacco is metered through unit 18 and conveyed by a screw feeder 36 to a slurry mixer 19 via pipe 20.

The binder solution for the slurry is prepared by mixing additives and water in mixer 21. The additives comprise sodium carboxy methyl cellulose (SCMC) and a wet strength agent, e.g. glyoxal. The prepared solution is then pumped through pipe 22 to a holding vessel 23 by pump 38. From the holding vessel the solution is metered through unit 24 and pumped along pipe 25 to the slurry mixer 19 by pump 37.

By means of metering units 18 and 24 a slurry is prepared in the mixer 19 whose formulation lies within the following ranges SCMC content: 4–6% w/w.

Glyoxal content: 0.5–2% dry wt.

Ground tobacco content: 35–45% w/w.

In a preferred composition the slurry comprises 39.6% tobacco, 4.5% SCMC and 0.9% glyoxal (dry wt.) i.e. 45% solids content and 55% water. After the slurry as been thoroughly mixed the resultant slurry is conveyed through screw conveyor 26 to a further holding vessel 27. From the holding vessel 27 the slurry is conveyed through a variable speed screw feeding device 28 to a roller assembly 29. The roller assembly 29 comprises a stainless steel casting band conveyor 30 onto which the slurry is extruded by passing it beneath a roller 31. The roller 31 is driven so that it rotates peripherally in the same direction as the band conveyor 30. The speed of rotation of the roller 31 may be varied by variable speed drive 32 to obtain the correct roller/-band speed ratio i.e. 1:3. The resulting rolled moist sheet passes on the conveyor 30 through an oven 33 where it is dried to the correct moisture content of 18–20%. At the end of the conveyor 30 the dried sheet is removed by a doctor blade 34. The sheet may then be slit and/or cross cut by device 35 to the required size.

Figure 2:
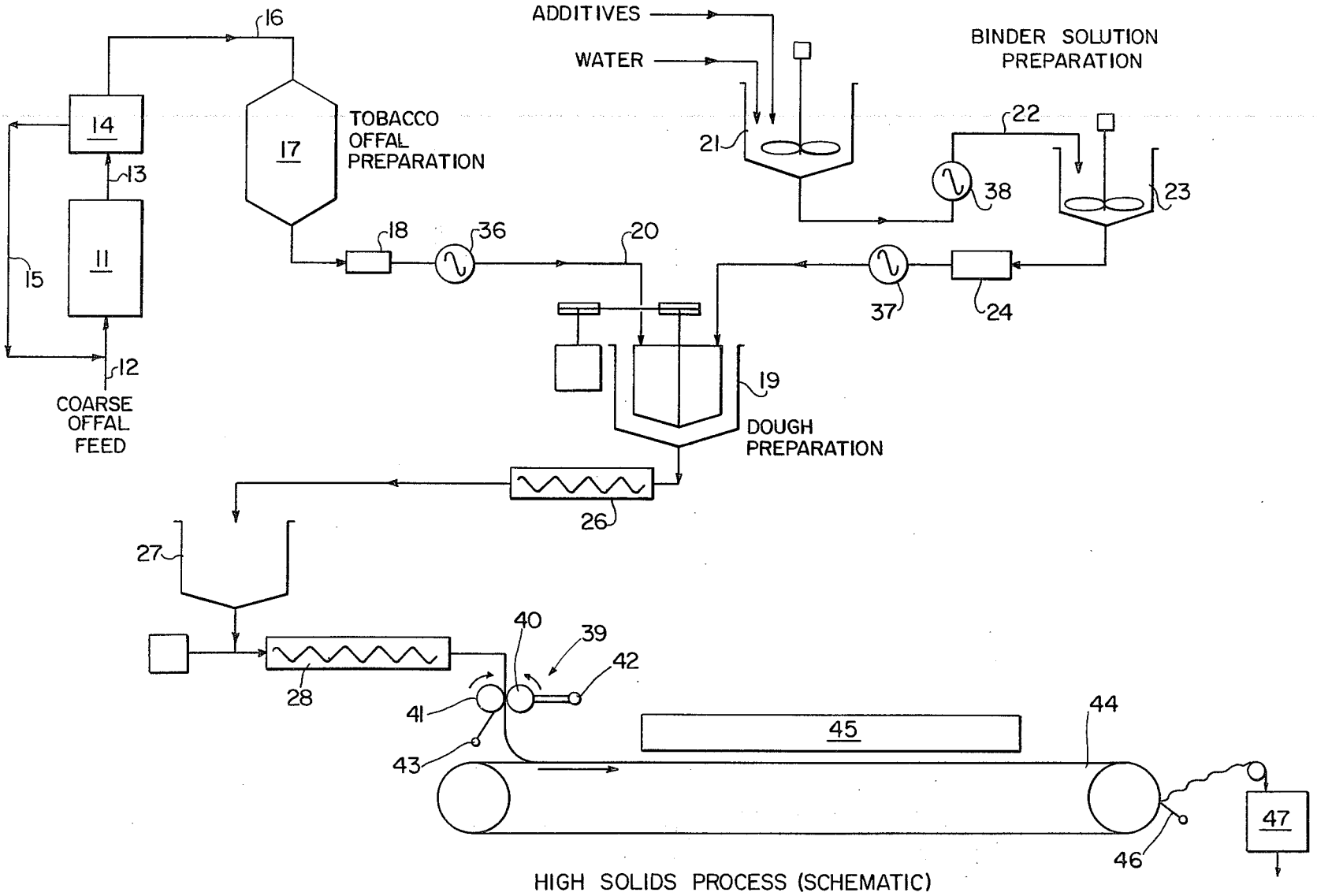

FIG. 2 shows a second embodiment of an apparatus for forming reconstituted tobacco sheet. The reference numerals 11 to 28 refer to the same components as in FIG. 1 and the initial stages in the process are the same. However, the slurry is in this case prepared with a total solids content within the range 60–70% by weight i.e. a slurry containing 30–40% water. In a preferred composition the slurry comprises 57.4% tobacco, 6.4% SCMC, 1.2% glyoxal and 35% water. This increased solids content is accommodated by the arrangement of rollers shown generally by 39. The roller assembly comprises a pair of rollers 40 and 41 each driven independently so that they contra-rotate. The speed of rotation of roller 40 may be varied by variable speed drive 42. Rolled sheet produced through the rollers is removed by doctor blade 43. In order to ensure that the sheet is correctly formed and may be cleanly removed by the doctor blade 43 the roller speed ratio is set at 1:2 by varying speed drive 42. The resultant rolled sheet falls onto a conventional wire mesh conveyor 44 and is dried as it passes beneath oven 45 to the correct moisture content of 18–20%. At the end of conveyor 44 the dried sheet is removed by doctor blade 46 and is then cross-cut and/or slit by device 47.

A table is set out below showing the various properties of illustrative sheets made in accordance with the invention compared with conventional roller tobacco sheet.

| | Sheet Physical Test Results | | | | | |
|---|---|---|---|---|---|---|
| B.S. Mesh size Extruded sheet. | Tensile ($Nm^{-1}$) | Elongation (%) | Basis Wt. ($gm^{-2}$) | equilibrium moisture content | Stiffness (mN) | Thickness (mm/100) |
| ≦ 120 Sheet 125 Microns | 120 | 0.1 | 59.6 | 9.4 | 29.1 | 13.3 |

-continued

| B.S. Mesh size Extruded sheet. | Sheet Physical Test Results Tensile ($Nm^{-1}$) | Elongation (%) | Basis Wt. ($gm^{-2}$) | equilibrium moisture content | Stiffness (mN) | Thickness (mm/100) |
|---|---|---|---|---|---|---|
| at 45% by weight ≦ 60 Sheet 250 Microns | 382 | 0.1 | 81.5 | 11.4 | 91.8 | 17.3 |
| at 45% by weight ≦ 60 Sheet 250 Microns | 500 | 0.5 | 100 | 10.5 | 150 | 20 |
| at 65% by weight Conventional, low solids content cast tobacco sheet | 200 | 0.1 | 50 | 12.0 | 15 | 15 |
| Conventional, high solids content sheet rolled through multi-roll system. | 300 | 0.5 | 110 | 13.0 | 160 | 24 |

Alternative binders, for example Pectin or other natural gums or synthetic cellulose gums may be used in the production of the sheet.

The production of reconstituted tobacco sheet in accordance with the invention involves a reduction in energy costs in the region of 5 to 1 as compared with a conventional, low-solids casting process.

It is envisaged that a portion of the binder and additives could be mixed in mixer 21 with the remainder being mixed directly into mixer 19.

It is also envisaged that other additives may be included in the slurry such as humectants, burn modifiers and flavourants, and small quantities of cellulose fibres to strengthen the sheet.

The binder solution may comprise, by weight of the slurry, 3–6% of a cellulose binder e.g. SCMC and 0.5–2% of a wet strength agent e.g. glyoxal.

Thus by forming a slurry having a composition within the above specified range and having the specified particle size it is possible to extrude the tobacco sheet through a more simple roller system than has previously been possible with considerable saving in energy costs due to the reduced need for drying the sheet. The simplicity of the roller assembly also reduces the purchasing and maintainance costs of the apparatus.

We claim:

1. A method of forming a continuous tobacco sheet comprising the steps of (a) forming a slurry comprising 35–60% by weight of ground tobacco particles having a particle size of less than 250 microns, 4–10% by weight of binder and 30–60% by weight of water, (b) extruding the slurry between a pair of contra-rotating rollers onto an endless casting conveyor to form an extruded sheet thereon wherein one of the contra-rotating rollers supports the casting conveyor and (c) drying the extruded sheet on the casting conveyor.

2. A method as claimed in claim 1 wherein the slurry comprises 65% by weight of ground tobacco particles.

3. A method as claimed in claim 1 wherein the slurry comprises 40% by weight of ground tobacco particles.

4. A method as claimed in claim 1 wherein the binder comprises, by percentage weight of the slurry, 3–6% of a cellulose binder and 0.5–2% of a wet strength agent.

5. A method as claimed in claim 4 wherein the binder comprises 4–6% by weight of the slurry.

6. A method as claimed in claim 1 wherein the extruded sheet is dried to a moisture content of 18–20%.

7. A method of forming a continuous tobacco sheet comprising the steps of (a) forming a slurry comprising water and 45–70% by weight of solids content, said solids content including ground tobacco particles having a particle size of less than 250 microns and binder, (b) extruding the slurry between a pair of contra-rotating rollers onto a conveyor to form an extruded sheet and, (c) drying the extruded sheet while supported on the conveyor.

* * * * *